US009221147B2

(12) United States Patent
Qian et al.

(10) Patent No.: US 9,221,147 B2
(45) Date of Patent: Dec. 29, 2015

(54) ENDPOINTING WITH SELECTIVE SPECTRAL MONITORING

(71) Applicants: Jun Qian, Sunnyvale, CA (US); Sivakumar Dhandapani, San Jose, CA (US); Benjamin Cherian, San Jose, CA (US); Thomas H. Osterheld, Mountain View, CA (US); Jeffrey Drue David, San Jose, CA (US); Gregory E. Menk, Pleasanton, CA (US); Boguslaw A. Swedek, Cupertino, CA (US); Doyle E. Bennett, Santa Clara, CA (US)

(72) Inventors: Jun Qian, Sunnyvale, CA (US); Sivakumar Dhandapani, San Jose, CA (US); Benjamin Cherian, San Jose, CA (US); Thomas H. Osterheld, Mountain View, CA (US); Jeffrey Drue David, San Jose, CA (US); Gregory E. Menk, Pleasanton, CA (US); Boguslaw A. Swedek, Cupertino, CA (US); Doyle E. Bennett, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 511 days.

(21) Appl. No.: 13/658,737

(22) Filed: Oct. 23, 2012

(65) Prior Publication Data

US 2014/0113524 A1 Apr. 24, 2014

(51) Int. Cl.

| | |
|---|---|
| ***G06F 19/00*** | (2011.01) |
| ***B24B 37/013*** | (2012.01) |
| ***B24B 49/12*** | (2006.01) |

(52) U.S. Cl.

CPC ..... *B24B 37/013* (2013.01); *B24B 49/12* (2013.01)

(58) Field of Classification Search

CPC ..... B24B 37/013; B24B 49/12
USPC ..... 700/121, 160, 164; 438/16; 451/5
See application file for complete search history.

(56) References Cited

U.S. PATENT DOCUMENTS

| | | | | |
|---|---|---|---|---|
| 5,747,380 | A | 5/1998 | Yu et al. | |
| 6,153,116 | A | 11/2000 | Yang et al. | |
| 6,271,047 | B1 | 8/2001 | Ushio et al. | |
| 6,358,327 | B1 | 3/2002 | Pokharna et al. | |
| 6,806,948 | B2 | 10/2004 | Katz et al. | |
| 8,751,033 | B2 * | 6/2014 | David et al. | 700/121 |
| 8,808,059 | B1 * | 8/2014 | David | 451/5 |
| 8,814,631 | B2 * | 8/2014 | David et al. | 451/5 |
| 8,834,229 | B2 * | 9/2014 | David et al. | 451/5 |
| 8,930,013 | B2 * | 1/2015 | David et al. | 700/164 |
| 8,944,884 | B2 | 2/2015 | David et al. | |
| 2003/0053042 | A1 | 3/2003 | Chen | |
| 2008/0099443 | A1 * | 5/2008 | Benvegnu et al. | 216/84 |
| 2010/0217430 | A1 | 8/2010 | David et al. | |
| 2010/0284007 | A1 | 11/2010 | Benvegnu et al. | |
| 2010/0316962 | A1 | 12/2010 | Newell | |
| 2011/0081829 | A1 * | 4/2011 | Ohta et al. | 451/6 |
| 2011/0256805 | A1 | 10/2011 | David et al. | |
| 2011/0282477 | A1 * | 11/2011 | Lee et al. | 700/103 |
| 2011/0287694 | A1 * | 11/2011 | Benvegnu et al. | 451/5 |
| 2012/0124589 | A1 * | 5/2012 | Rupley et al. | 718/103 |
| 2012/0278028 | A1 | 11/2012 | David et al. | |
| 2013/0280827 | A1 | 10/2013 | Benvegnu et al. | |
| 2014/0020829 | A1 | 1/2014 | Chen et al. | |
| 2014/0045282 | A1 * | 2/2014 | Lee et al. | 438/16 |
| 2014/0080232 | A1 * | 3/2014 | Benvegnu et al. | 438/8 |
| 2014/0222188 | A1 * | 8/2014 | Duboust et al. | 700/164 |

* cited by examiner

*Primary Examiner* — Mohammad Ali
*Assistant Examiner* — Sheela S Rao
(74) *Attorney, Agent, or Firm* — Fish & Richardson P.C.

(57) ABSTRACT

A method of controlling polishing includes polishing a substrate, monitoring the substrate during polishing with an in-situ spectrographic monitoring system to generate a sequence of measured spectra, selecting less than all of the measured spectra to generate a sequence of selected spectra, generating a sequence of values from the sequence of selected spectra, and determining at least one of a polishing endpoint or an adjustment for a polishing rate based on the sequence of values.

24 Claims, 4 Drawing Sheets

ENDPOINTING WITH SELECTIVE SPECTRAL MONITORING

TECHNICAL FIELD

The present disclosure relates to optical monitoring during processing of substrates.

BACKGROUND

An integrated circuit is typically formed on a substrate by the sequential deposition of conductive, semiconductive, or insulative layers on a silicon wafer. A variety of fabrication processes require planarization of a layer on the substrate. For example, for certain applications, e.g., polishing of a metal layer to form vias, plugs, and lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. Abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, determining the polishing endpoint merely as a function of polishing time can lead to within-wafer non-uniformity (WTWNU) and wafer-to-wafer non-uniformity (WTWNU).

In some systems, a substrate is optically monitored in-situ during polishing, e.g., through a window in the polishing pad. However, existing optical monitoring techniques may not satisfy increasing demands of semiconductor device manufacturers.

SUMMARY

In some in-situ monitoring processes, a sequence of spectra is measured from a substrate. However, due to relative motion between the substrate and the light beam, the spectra in the sequence can result from measurements at different locations on the substrate. Consequently, if the substrate being monitored is a patterned substrate, the different locations can correspond to different layer stacks, which provide different spectra. In addition, individual spectra can be the result of a combination of reflections from regions with different layer stacks. This can make detection of the polishing endpoint or control of polishing rates difficult.

However, the spectra can be sorted based on a variety of features, spectra of interest can be selected, and the polishing endpoint or control of polishing rates can be based on the selected spectra.

In one aspect, a method of controlling polishing includes polishing a substrate, monitoring the substrate during polishing with an in-situ spectrographic monitoring system to generate a sequence of measured spectra, selecting less than all of the measured spectra to generate a sequence of selected spectra, generating a sequence of values from the sequence of selected spectra, and determining at least one of a polishing endpoint or an adjustment for a polishing rate based on the sequence of values.

Implementations can include on or more of the following features. Selecting less than all of the measured spectra may include comparing each measured spectrum from the sequence of measured spectra to a baseline spectrum. The baseline spectrum may be determined empirically, calculated from an optical model, or taken from literature. The baseline spectrum may be determined empirically using a spectrographic metrology system that generates a measurements spot smaller than a measurement spot generated by the in-situ monitoring system. Comparing may include calculating a sum-of-squares difference, a sum of absolute differences, or a cross-correlation between each measured spectrum and the baseline spectrum. Selecting less than all of the measured spectra may include determining the presence or absence of a feature in the measured spectrum. The feature may be a peak, valley or inflection point in a particular wavelength range. The feature comprises a peak with a magnitude above a certain level or a valley with magnitude below a certain level. The feature may be peaks or valleys separated by a wavelength distance within a particular range. Selecting less than all of the measured spectra may include determining the presence or absence of a feature relative to a prior measured spectrum from the sequence. Selecting may include determining whether a peak or valley of the measured spectrum has shifted relative to the prior measured spectrum by an amount within a predetermined range. Selecting may include determining whether multiple peaks or valleys in the measured spectrum have shifted in the same direction relative to the prior measured spectrum. Selecting less than all of the measured spectra may include calculating a position of a measurement within a die. Selecting less than all of the measured spectra may include determining whether the position of the measurement is within a predetermined region within a die.

In another aspect, a method of controlling polishing includes polishing a substrate, monitoring a substrate during polishing with an in-situ spectrographic monitoring system to generate a sequence of measured spectra, sorting the measured spectra into a plurality of groups based on the measured spectra to generate a first sequence of spectra for a first group of the plurality of groups and a second sequence of spectra for a second group of the plurality of groups, generating a first sequence of values from the first sequence of spectra based on a first algorithm, generating a second sequence of values from the second sequence of spectra based on a different second algorithm, and determining at least one of a polishing endpoint or an adjustment for a polishing rate based on the first sequence of values and the second sequence of values.

Implementations can include on or more of the following features. Sorting the measured spectra may include comparing each measured spectrum against a baseline spectrum. Sorting the measured spectra may include determining the presence or absence of a feature in each spectrum. The first algorithm may include for each measured spectrum in the first group identifying a matching reference spectrum from a library of reference spectra, and the second algorithm may include for each measured spectrum in the second group tracking a characteristic of a spectral feature. The first algorithm may include for each measured spectrum in the first group fitting an optical model to the measured spectrum, and the second algorithm may include for measured spectra in a second group identifying a matching reference spectrum from a library of reference spectra or tracking a characteristic of a spectral feature. The first algorithm may include for each measured spectrum in the first group fitting a first optical model to the measured spectrum, and the second algorithm may include for each measured spectrum in the second group fitting a different second optical model to the measured spectrum.

In another aspect, a non-transitory computer program product, tangibly embodied in a machine readable storage device, includes instructions to carry out the method.

Implementations may optionally include one or more of the following advantages.

Reliability of the endpoint system to detect a desired polishing endpoint can be improved, and within-wafer and wafer-to-wafer thickness non-uniformity (WTWNU and WTWNU) can be reduced.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
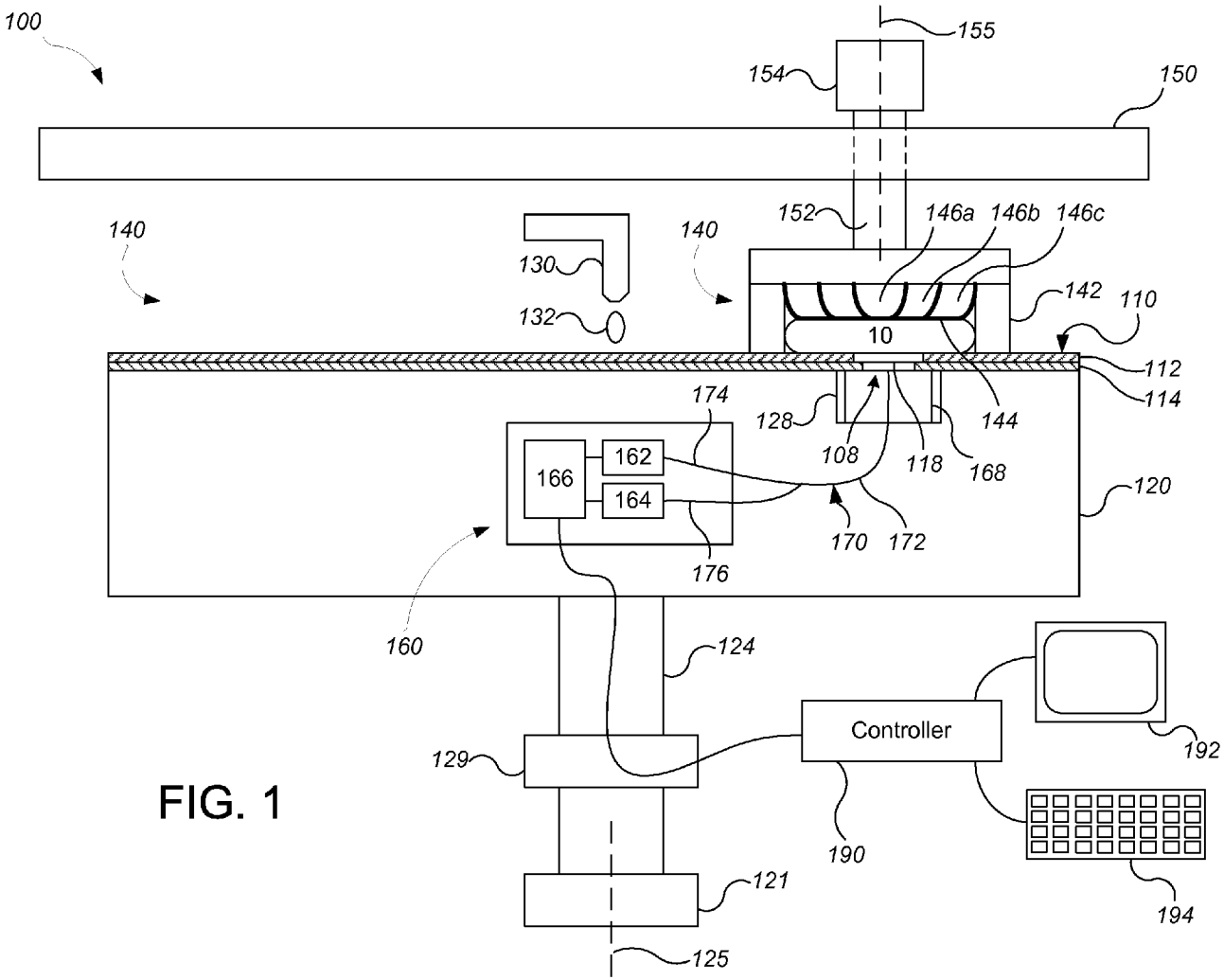
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as slurry, onto the polishing pad 110. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. The carrier head 140 can have independent control of the polishing parameters, for example pressure, associated with each respective substrate.

In particular, the carrier head 140 can include a retaining ring 142 to retain the substrate 10 below a flexible membrane 144. The carrier head 140 also includes a plurality of independently controllable pressurizable chambers defined by the membrane, e.g., three chambers 146*a*-146*c*, which can apply independently controllable pressures to associated zones on the flexible membrane 144 and thus on the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel or a track, and is connected by a drive shaft 152 to a carrier head rotation motor 154 so that the carrier head can rotate about an axis 155. Optionally the carrier head 140 can oscillate laterally, e.g., on sliders on the carousel 150 or track; or by rotational oscillation of the carousel itself. In operation, the platen is rotated about its central axis 125, and the carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently.

The polishing apparatus also includes an in-situ monitoring system 160. The in-situ monitoring system generates a time-varying sequence of values that depend on the thickness of a layer on the substrate.

The in-situ-monitoring system 160 is an optical monitoring system. In particular, the in-situ-monitoring system 160 measures a sequence of spectra of light reflected from a substrate during polishing.

An optical access 108 through the polishing pad can be provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber can include a trunk 172 positioned in proximity to the optical access, and two branches 174 and 176 connected to the light source 162 and detector 164, respectively.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

Figure 2:
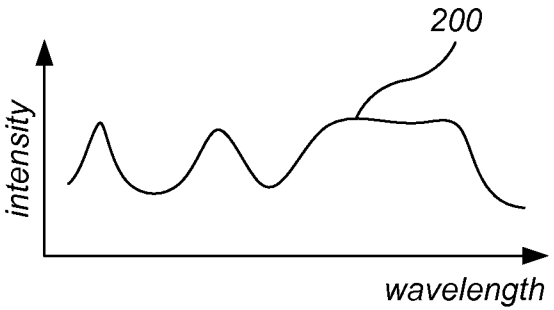
FIG. 2 illustrates a measured spectrum from the in-situ optical monitoring system.

The light source 162 can be operable to emit ultraviolet (UV), visible or near-infrared (NIR) light. The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). FIG. 2 illustrates an example of a measured spectrum 200 with intensity as a function of wavelength.

As noted above, the light source 162 and light detector 164 can be connected to a computing device, e.g., the controller 190, operable to control their operation and receive their signals. The computing device can include a microprocessor situated near the polishing apparatus. For example, the computing device can be a programmable computer. With respect to control, the computing device can, for example, synchronize activation of the light source with the rotation of the platen 120. A display 192, e.g., a LED screen, and a user input device 194, e.g., a keyboard and/or a mouse, can be connected to the controller 190.

In operation, the controller 190 can receive, for example, a signal that carries information describing a spectrum of the light received by the light detector for a particular flash of the light source or time frame of the detector. Thus, this spectrum is a spectrum measured in-situ during polishing.

Without being limited to any particular theory, the spectrum of light reflected from the substrate 10 evolves as polishing progresses due to changes in the thickness of the outermost layer, thus yielding a sequence of time-varying spectra.

Figure 3:
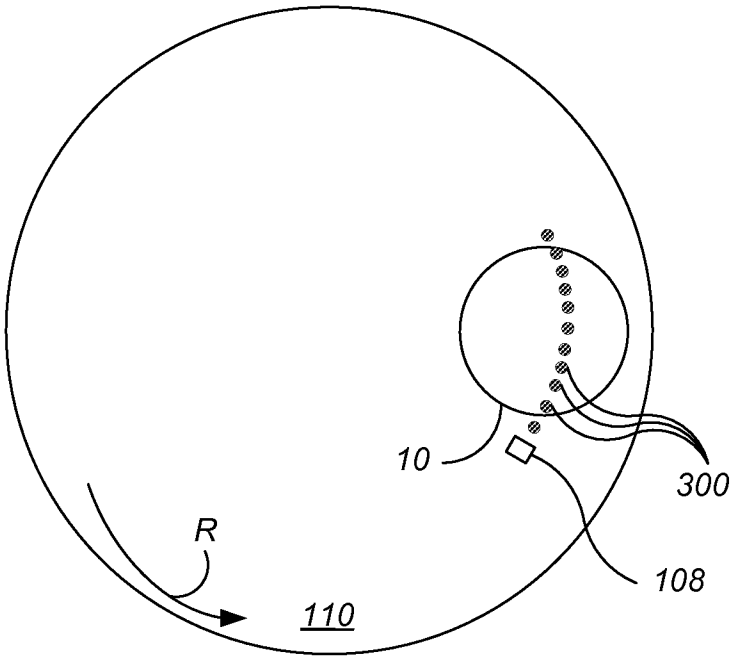
FIG. 3 illustrates a path of a sequence of spectral measurements on the substrate.

The optical monitoring system 160 is configured to generate a sequence of measured spectra at a measurement frequency. The relative motion between the substrate 10 and the optical access 108 causes spectra in the sequence to be measured at different positions on the substrate 10. In some implementations, the light beam generated by the light source 162 emerges from a point that rotates (shown by arrow R in FIG. 3) with the platen 120. As shown in FIG. 3, in such an implementation, the relative motion between the substrate 10 and the optical access 108 can cause spectra to be measured at positions 300 in a path across the substrate 10.

In some implementations only one spectrum is measured per rotation of the platen. In addition, in some implementations, the emitting point of the light beam is stationary and measurements are taken only when the optical access 108 aligns with the light beam.

As discussed below, the spectra of the sequence are subjected to a selection process that selects some of the spectra for use in endpoint detection or process control. In general, at least one, but less than all, of the spectra measured in a single sweep of the optical access 108 across the substrate are selected. If more than one spectrum is selected, the selected spectra can be combined to provide a spectrum that is then used in the endpoint detection or process control algorithm.

If the substrate being monitored is a patterned substrate, the different positions on the substrate can correspond to different layer stacks. The different layer stacks would be expected to provide different spectra as a function of the thickness of the overlying layer, e.g., even for an overlying layer of the same thickness the resulting spectra could be different. In addition, individual spectra can be the result of a combination of reflections from regions with different layer stacks.

Because of their different shapes, use of spectra from different regions of a patterned substrate can introduce error into the endpoint determination. In addition, a semiconductor device manufacturer can have different specifications for different devices being manufactured. For example, for some devices a manufacturer may wish to monitor a thickness of an overlying layer in a trench region, whereas for other devices a manufacturer may wish to monitor a thickness of an overlying layer in a region with dense features.

In order to account for this, the measured spectra can be sorted based on a variety of features, spectra of interest can be selected, and the polishing endpoint or control of polishing rates can be based on the selected spectra. In general, this permits the polishing endpoint or control of polishing rates to be performed based on spectra from the desired regions of the substrate. In addition, by sorting and selecting the spectra, more accurate endpointing or polishing uniformity can be achieved.

The sorting can include any of the following techniques:

1) Comparison of Measured Spectrum Against a Baseline Spectrum

A baseline spectrum of a particular region on a polished or unpolished substrate can be determined. The particular region of the substrate can correspond to a scribe line, a contact pad, a portion of a die having a relatively high density of features (compared to other portions of the die), or a portion of a die having a relatively low density of features (compared to other portions of the die).

The baseline spectrum can be determined empirically, i.e., by measuring a spectrum from the particular region using a metrology system that provides more precise positioning of the spectral measurement than the in-situ monitoring system 160, e.g., using a stand-alone metrology system. The stand-alone metrology system can measure a spot on the substrate that is smaller than the spot measured by the in-situ monitoring system 160, e.g., the stand-alone metrology system can use a light beam having a smaller diameter than the light beam of the in-situ monitoring system 160.

Alternatively, a baseline spectrum of a particular region on a polished or unpolished substrate can be calculated based on an optical model, e.g., as described in U.S. application Ser. No. 13/096,777, the entire disclosure of which is incorporated by reference. The optical model can include the thickness, index of refraction, and coefficient of extinction of each layer in the stack. The optical model can also include the effects from a region that overlies multiple different layer stacks, e.g., due to combination of reflection from the different layer stacks. In this case the optical model can be based on knowledge of the layout of features within the die and/or layout of die on the substrate. The optical model can also include the effects of diffraction of features in the die, e.g., as described in U.S. application Ser. No. 13/456,035, the entire disclosure of which is incorporated by reference.

Alternatively, a baseline spectrum can be determined from literature

Each measured spectrum is compared against the baseline spectrum. A measured spectrum that differs from the baseline spectrum by less than a threshold amount can be selected. The comparison of the measured spectrum against the baseline spectrum can be a sum-of-squared differences, a sum of absolute differences, or a cross-correlation. In the case of sum-of-square or sum-of absolute differences, the controller can select a spectrum with a total difference below a threshold; in the case of a cross-correlation, the controller can select a spectrum with a correlation above a threshold.

2) Analysis of Particular Features in the Measured Spectrum

The measured spectrum can be analyzed for the presence or absence of various features. For example, spectra can be selected based on the detection of presence or absence of a peak, valley or inflection point in a particular wavelength range. The particular wavelength range is a subset (less than all) of the wavelength range measured and/or used in the monitoring algorithm. As another example, spectra can be selected based on detection of the presence or absence of a peak with a magnitude above a certain level or a valley with magnitude below a certain level. As another example, spectra can be selected based on the presence or absence of a peak or valley with a width within a particular range. As another example, spectra can be selected based on detection of presence or absence of peaks or valleys separated by a wavelength distance within a particular range.

The criteria for selecting spectra based on presence or absence of various features can be founded on knowledge from calculations, empirical observation, or the literature.

3) Analysis of a Measured Spectrum Against a Prior Measured Spectrum from the Sequence The measured spectrum can be analyzed for the presence or absence of various features relative to a prior measured spectrum from the sequence. For example, spectra can be selected based on detection that a peak or valley of the measured spectrum has shifted relative to the prior measured spectrum by an amount within a predetermined range. As another example, spectra can be selected based on detection that multiple peaks or valleys have shifted in the same direction relative to the prior measured spectrum.

The criteria for selecting spectra based on changes relative to a prior measured spectrum can be founded on knowledge from calculations, empirical observation, or the literature.

4) Analysis of Location of Spectral Measurement within a Die

If the angular position of the substrate can be determined, e.g., as described in U.S. patent application Ser. No. 13/552,377, incorporated by reference, then the relative position of a measurement within a die can be calculated. Spectra can be selected based on their calculated measurement location within a die.

A measured spectrum can be modified prior to determining whether the spectrum has been selected. For example, spectral features can be removed from the measured spectrum based on offline measurements, such as measurements made by a spectrometer having a smaller beam diameter or based on measurements by a different type of spectrometer or measurements in the public domain or literature. One or more background spectra can be subtracted from the measured spectrum. Each background spectrum can based on offline measurements, such as measurements with a spectrometer having a smaller beam diameter or based on measurements by a different type of spectrometer or measurements in the public domain or literature.

Once a measured spectrum has been selected, a monitoring technique can be used to generate a value from the spectrum. On the other hand, spectra that are not selected are not used to generate values, and thus are excluded from the endpoint or process control calculations. A variety of monitoring techniques can be used to convert the selected spectrum to a value.

One monitoring technique is, for each measured spectrum, to identify a matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for each matching reference spectrum, a time-varying sequence of characterizing values can be generated. This technique is described in U.S. Patent Publication No. 2010-0217430, which is incorporated by reference. Another monitoring technique is to track a characteristic of a spectral feature from the measured spectra, e.g., a wavelength or width of a peak or valley in the measured spectra. The wavelength or width values of the feature from the measured spectra provide the time-varying sequence of values. This technique is described in U.S. Patent Publication No. 2011-0256805, which is incorporated by reference. Another monitoring technique is to fit an optical model to each measured spectrum from the sequence of measured spectra. In particular, a parameter of the optical model is optimized to provide the best fit of the model to the measured spectrum. The parameter value generated for each measured spectrum generates a time-varying sequence of parameter values. This technique is described in U.S. Patent Application No. 61/608,284, filed Mar. 8, 2012, which is incorporated by reference. Another monitoring technique is to perform a Fourier transform of each measured spectrum to generate a sequence of transformed spectra. A position of one of the peaks from the transformed spectrum is measured. The position value generated for each measured spectrum generates a time-varying sequence position values. This technique is described in U.S. patent application Ser. No. 13/454,002, filed Apr. 23, 2012, which is incorporated by reference.

Figure 4:
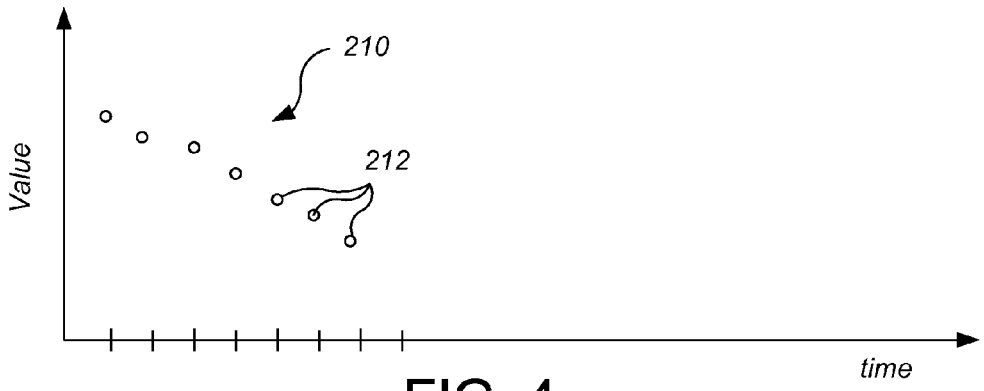
FIG. 4 illustrates a sequence of values generated by the in-situ optical monitoring system.

Referring to FIG. 4, which illustrates the results for only a single zone of a substrate, a time-varying sequence of values 212 is illustrated. This sequence of values can be termed a trace 210. In general, for a polishing system with a rotating platen, the trace 210 can include one, e.g., exactly one, value per sweep of the sensor of the optical monitoring system below the substrate. If multiple zones on a substrate are being monitored, then there can be one value per sweep per zone. Multiple measurements within a zone can be combined to generate a single value that is used for control of the endpoint and/or pressure. However, it is also possible for more than one value to be generated per sweep of the sensor.

Prior to commencement of the polishing operation, the user or the equipment manufacturer can define a function 214 that will be fit to the time-varying sequence of values 212. For example, the function can be a polynomial function, e.g., a linear function. In particular, the controller 190 can display a graphical user interface on the display 192, and the user can input the user-input function 214 with the user input device 194.

Figure 5:
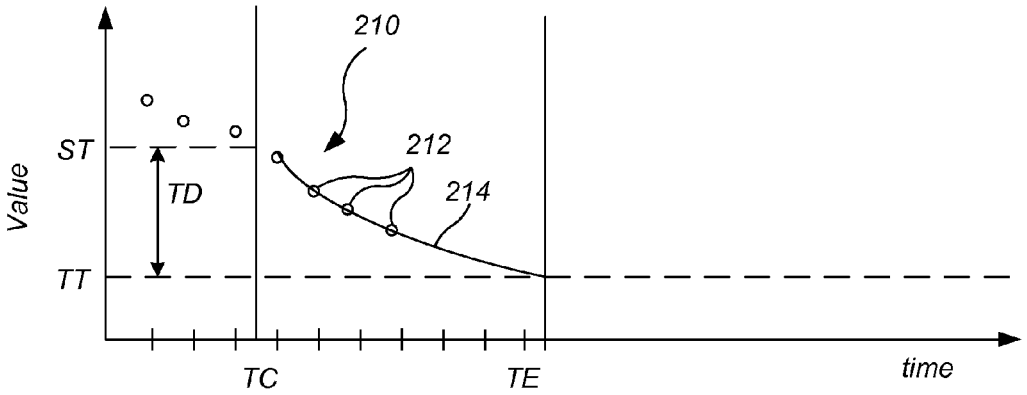
FIG. 5 illustrates a function fit to at least some of the sequence of values.

As shown in FIG. 5, the function 214 is fit to the sequence of values 212. Multiple techniques exist to fit generalized functions to data. For linear functions such as polynomials, a general linear least squares approach can be employed.

Optionally, the function 214 can be fit to the values collected after time a TC. Values collected before the time TC can ignored when fitting the function to the sequence of values. For example, this can assist in elimination of noise in the measured spectra that can occur early in the polishing process, or it can remove spectra measured during polishing of another layer. Polishing can be halted at an endpoint time TE that the function 214 equals a target value TT.

Figure 6:
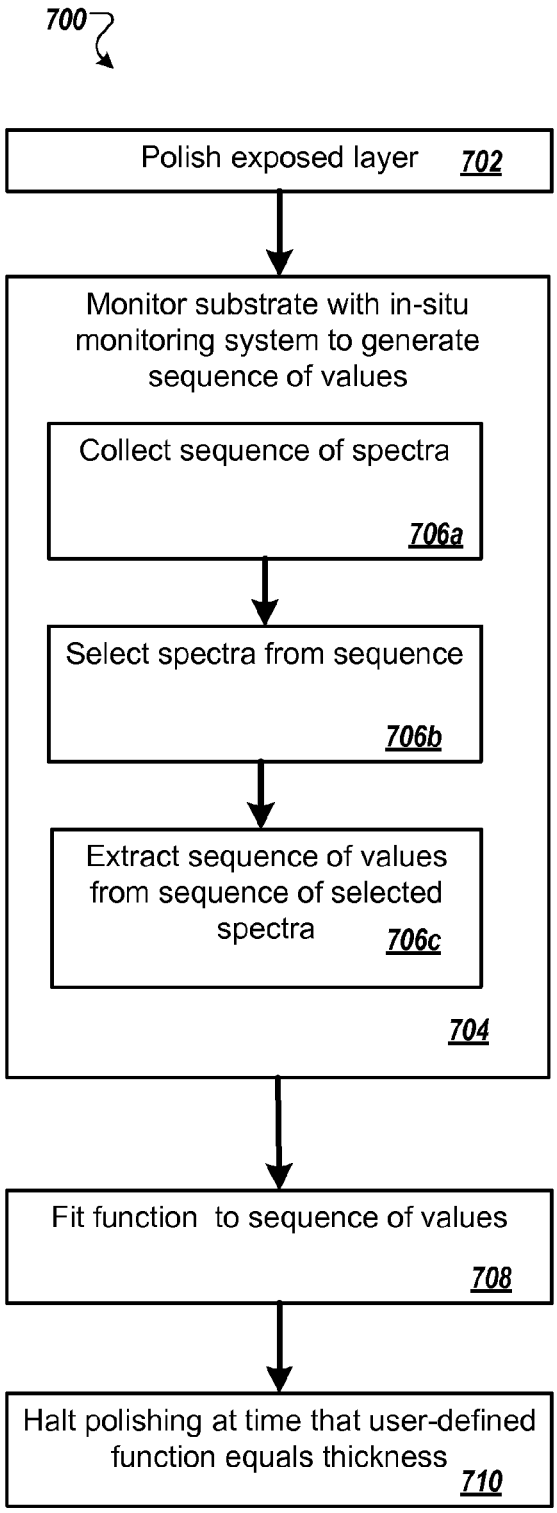
FIG. 6 is a flow diagram of an example process for controlling a polishing operation.

FIG. 6 shows a flow chart of a method 700 of polishing a product substrate. The product substrate is polished (step 702), and a sequence of values are generated by the in-situ monitoring system (step 704). For example, the in-situ monitoring system can collect a sequence of spectra (step 706*a*), spectra from the sequence are selected (step 706*b*), e.g., using any of the techniques described above, and the sequence of values is extracted from the sequence of selected spectra (step 706*c*), e.g., again using any of the techniques described above. The user-defined function is fit to the sequence of values (step 708).

The time at which the user-defined function will equal the target value can be calculated. Polishing can be halted at the time that user-defined function equals a target value (step 710). For example, in the context of thickness as the endpoint parameter, the time at which the user-defined function will equal the target thickness can be calculated. The target thickness TT can be set by the user prior to the polishing operation and stored. Alternatively, a target amount to remove can be set by the user, and a target thickness TT can be calculated from the target amount to remove (see FIG. 5).

In another implementation, measured spectra are sorted into multiple groups. The different groups can represent different regions within a die, e.g., the scribe line, a contact pad, a region with a high density of features, or a region with a low density of features. A measured spectrum can be assigned to a single group out of the multiple groups.

The sorting can be performed by a series of selection steps, using any of the selection procedures described above. In some implementations, the controller can determine whether a measured spectrum meets a first selection criterion. If the measured spectrum meets the first selection criterion, the measured spectrum is assigned to a first group. If a measured spectrum does not meet the first selection criterion, then the controller can determine whether a measured spectrum meets a second selection criterion. If the measured spectrum meets the second selection criterion, the measured spectrum is assigned to a second group.

For example, the controller can compare a measured spectrum to a first baseline spectrum. If the measured spectrum differs from the first baseline spectrum by less than a threshold amount, the measured spectrum can be assigned to a first group. If the measured spectrum is not sufficiently similar to the first baseline spectrum, then the measured spectrum can be compared against a different, second baseline spectrum. If the measured spectrum differs from the second baseline spectrum by less than a threshold amount, the measured spectrum can be assigned to a second group. However, many other combinations of selection procedures are possible: comparison of measured spectrum against a baseline spectrum followed by analysis of particular features in the measured spectrum, or vice versa; determination of the presence or absence of a first feature in the measured spectrum followed by determination of the presence or absence of a different second feature in the measured spectrum; analysis of a measured spectrum against a prior measured spectrum from the sequence followed by either a comparison of the measured spectrum against a baseline spectrum or an analysis of particular features in the measured spectrum various features, or vice versa. Other combinations of selection techniques are possible to sort the measured spectra into the groups.

Different monitoring techniques can be used for different groups of measured spectra. As one example, for measured spectra in a first group, a first matching reference spectrum from a first library of reference spectra can be identified, and for measured spectra in a second group, a second matching reference spectrum from a second library of different reference spectra can be identified. As another example, for measured spectra in a first group, a matching reference spectrum from a library of reference spectra can be identified, and for measured spectra in a second group, a characteristic of a spectral feature can be tracked. As another example, for measured spectra in a first group, a first characteristic of a first spectral feature can be tracked, and for measured spectra in a second group, a second characteristic of a different second spectral feature can be tracked. As another example, for measured spectra in a first group, an optical model can be fit to each measured spectrum, and for measured spectra in a second group, a matching reference spectrum from a library of reference spectra can be identified or a characteristic of a spectral feature can be tracked. As another example, for measured spectra in a first group, a first optical model can be fit to each measured spectrum, and for measured spectra in a second group, a different second optical model can be fit to each measured spectrum.

The different monitoring techniques for the multiple groups of spectra can result in multiple sequences of values, e.g., one sequence per group of spectra. The polishing endpoint or change in polishing parameters can be based on the multiple sequences of values. For example, polishing endpoint or control of parameters could be based on the sequence of values having the least noise, e.g., having the best fit to a function. The polishing endpoint or control of parameters could be based on endpoint being detected for all of the groups, or based on the first endpoint detected for any of the groups.

In addition, it is possible to generate a sequence of values for different zones of the substrate, and use the sequences from different zones to adjust the pressure applied in the chambers of the carrier head to provide more uniform polishing, e.g., using techniques described in U.S. application Ser. No. 13/096,777, incorporated herein by reference (in general, the position value can be substituted for the index value to use similar techniques). In some implementations, the sequence of values is used to adjust the polishing rate of one or more zones of a substrate, but another in-situ monitoring system or technique is used to detect the polishing endpoint.

In addition, although the discussion above assumes a rotating platen with a sensor of the in-situ monitoring system installed in the platen, system could be applicable to other types of relative motion between the sensor of the monitoring system and the substrate. For example, in some implementations, e.g., orbital motion, the sensor traverses different positions on the substrate, but does not cross the edge of the substrate. In such cases, measurements can be collected at a certain frequency, e.g., 1 Hz or more.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A method of controlling polishing, comprising:

polishing a substrate;

monitoring the substrate during polishing with an in-situ spectrographic monitoring system to generate a sequence of measured spectra;

for each measured spectrum in the sequence of measured spectra, determining whether to include the measured spectrum as a selected spectrum based on at least one of determining the presence or absence of a feature in the measured spectrum, or determining a position of a feature in the measured spectrum relative to a prior measured spectrum from the sequence of measured spectra, such that less than all of the measured spectra are selected to generate a sequence of selected spectra;

generating a sequence of values from the sequence of selected spectra; and determining at least one of a polishing endpoint or an adjustment for a polishing rate based on the sequence of values.

2. The method of claim 1, wherein determining whether to include the measured spectrum comprises determining the presence or absence of a peak, valley or inflection point in a particular wavelength range.

3. The method of claim 1, wherein determining whether to include the measured spectrum comprises determining the presence or absence of a peak with a magnitude above a certain level or a valley with a magnitude below a certain level.

4. The method of claim 1, wherein determining whether to include the measured spectrum comprises determining the presence or absence of peaks or valleys separated by a wavelength distance within a particular range.

5. The method of claim 1, wherein determining whether to include the measured spectrum comprises determining whether a peak or valley of the measured spectrum has shifted relative to the prior measured spectrum by an amount within a predetermined range.

6. The method of claim 1, wherein determining whether to include the measured spectrum comprises determining whether multiple peaks or valleys in the measured spectrum have shifted in the same direction relative to the prior measured spectrum.

7. A method of controlling polishing, comprising:

polishing a substrate;

monitoring the substrate during polishing with an in-situ spectrographic monitoring system to generate a sequence of measured spectra;

for each measured spectrum from the sequence of measured spectra, sorting the measured spectrum into one of a plurality of groups based on the measured spectrum such that the measured spectra of the sequence of measured spectra generate a first sequence of spectra for a first group of the plurality of groups and a second sequence of spectra for a second group of the plurality of groups;

generating a first sequence of values from the first sequence of spectra based on a first algorithm;

generating a second sequence of values from the second sequence of spectra based on a different, second algorithm; and determining at least one of a polishing endpoint or an adjustment for a polishing rate based on the first sequence of values and the second sequence of values.

8. The method of claim 7, wherein sorting the measured spectrum comprises comparing the measured spectrum against a baseline spectrum.

9. The method of claim 7, wherein sorting the measured spectrum comprises determining the presence or absence of a feature in the measured spectrum.

10. The method of claim 7, wherein the first algorithm comprises for each measured spectrum in the first group identifying a matching reference spectrum from a library of reference spectra, and the second algorithm comprises for each measured spectrum in the second group tracking a characteristic of a spectral feature.

11. The method of claim 7, wherein the first algorithm comprises for each measured spectrum in the first group fitting an optical model to the measured spectrum, and the second algorithm comprises for each measured spectrum in the second group identifying a matching reference spectrum from a library of reference spectra or tracking a characteristic of a spectral feature.

12. The method of claim 7, wherein the first algorithm comprises for each measured spectrum in the first group fitting a first optical model to the measured spectrum, and the second algorithm comprises for each measured spectrum in the second group fitting a different second optical model to the measured spectrum.

13. A computer program product, tangibly embodied in a non-transitory computer-readable medium, comprising instructions for causing a processor to:

during polishing of a substrate, receive a sequence of measured spectra from an in-situ spectrographic monitoring system;

for each measured spectrum in the sequence of measured spectra, determine whether to include the measured spectrum as a selected spectrum based on at least one of determining the presence or absence of a feature in the measured spectrum, or determining a position of a feature in the measured spectrum relative to a prior measured spectrum from the sequence of measured spectra, such that less than all of the measured spectra are selected to generate a sequence of selected spectra;

generate a sequence of values from the sequence of selected spectra; and determine at least one of a polishing endpoint or an adjustment for a polishing rate based on the sequence of values.

14. The computer program product of claim 13, wherein the instructions to determine whether to include the measured spectrum comprise instructions to determine the presence or absence of a peak, valley or inflection point in a particular wavelength range.

15. The computer program product of claim 13, wherein the instructions determine whether to include the measured spectrum comprise instructions to determine the presence or absence of a peak with a magnitude above a certain level or a valley with a magnitude below a certain level.

16. The computer program product of claim 13, wherein the instructions to determine whether to include the measured spectrum comprise instructions to determine the presence or absence of peaks or valleys separated by a wavelength distance within a particular range.

17. The computer program product of claim 13, wherein the instructions to determine whether to include the measured spectrum comprise instructions to determine whether a peak or valley of the measured spectrum has shifted relative to the prior measured spectrum by an amount within a predetermined range.

18. The computer program product of claim 13, wherein the instructions to determine whether to include the measured spectrum comprise instructions to determine whether multiple peaks or valleys in the measured spectrum have shifted in the same direction relative to the prior measured spectrum.

19. A computer program product, tangibly embodied in a non-transitory computer-readable medium, comprising instructions for causing a processor to:

during polishing of a substrate, receive a sequence of measured spectra from an in-situ spectrographic monitoring system;

for each measured spectrum from the sequence of measured spectra, sort the measured spectrum into one of a plurality of groups based on the measured spectrum such that the measured spectra of the sequence of measured spectra generate a first sequence of spectra for a first group of the plurality of groups and a second sequence of spectra for a second group of the plurality of groups;

generate a first sequence of values from the first sequence of spectra based on a first algorithm;

generate a second sequence of values from the second sequence of spectra based on a different, second algorithm; and determine at least one of a polishing endpoint or an adjustment for a polishing rate based on the first sequence of values and the second sequence of values.

20. The computer program product of claim 19, wherein the instructions to sort the measured spectrum comprise instructions to compare the measured spectrum against a baseline spectrum.

21. The computer program product of claim 19, wherein the instructions to sort the measured spectrum comprise instructions to determining the presence or absence of a feature in the measured spectrum.

22. The computer program product of claim 19, wherein the first algorithm comprises instructions to, for each measured spectrum in the first group, identify a matching reference spectrum from a library of reference spectra, and the second algorithm comprises instructions to, for each measured spectrum in the second group, track a characteristic of a spectral feature.

23. The computer program product of claim 19, wherein the first algorithm comprises instructions to, for each measured spectrum in the first group, fit an optical model to the measured spectrum, and the second algorithm comprises instructions to, for each measured spectrum in the second group, identify a matching reference spectrum from a library of reference spectra or track a characteristic of a spectral feature.

24. The computer program product of claim 19, wherein the first algorithm comprises instructions to, for each measured spectrum in the first group, fit a first optical model to the measured spectrum, and the second algorithm comprises instructions to, for each measured spectrum in the second group, fit a different second optical model to the measured spectrum.

* * * * *